US009810476B2

(12) United States Patent
Kim et al.

(10) Patent No.: US 9,810,476 B2
(45) Date of Patent: Nov. 7, 2017

(54) REFRIGERATOR

(71) Applicant: Samsung Electronics Co., Ltd., Gyeonggi-do (KR)

(72) Inventors: Hyun Soo Kim, Gyeonggi-do (KR); Jong-Hyub Lee, Seoul (KR); Seo Jin Park, Gyeonggi-do (KR); Young Min Park, Seoul (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 0 days.

(21) Appl. No.: 14/986,531

(22) Filed: Dec. 31, 2015

(65) Prior Publication Data

US 2016/0195325 A1 Jul. 7, 2016

(30) Foreign Application Priority Data

Jan. 5, 2015 (KR) ..... 10-2015-0000551

(51) Int. Cl.
*F25D 23/00* (2006.01)
*F25D 23/02* (2006.01)
(Continued)

(52) U.S. Cl.
CPC ..... *F25D 23/028* (2013.01); *E05D 3/08* (2013.01); *E05D 7/04* (2013.01); *E05D 11/0054* (2013.01); *F25D 2323/024* (2013.01)

(58) Field of Classification Search
CPC ... Y10T 16/547; F25D 23/028; F25D 23/025; F25D 2323/024; E05D 11/0054;
(Continued)

(56) References Cited

U.S. PATENT DOCUMENTS 4,251,900 A * 2/1981 Lautenschlager ..... E05D 3/183 16/294
4,856,141 A * 8/1989 Sassenberg ..... E05D 5/08 16/250
(Continued)

FOREIGN PATENT DOCUMENTS

DE 1708224 * 11/1971
DE 2751682 * 5/1979
(Continued)

OTHER PUBLICATIONS

Extended European Search Report dated May 13, 2016 in connection with European Appl. No. 15203164.7; 8 pages.
(Continued)

*Primary Examiner* — Janet M Wilkens

(57) ABSTRACT

Disclosed herein is a refrigerator of which door is opened without interference by a structure positioned next to a side of the refrigerator. Since a main body and the door of the refrigerator are provided with hinge units, while the door is opening, the hinge units rotate in a direction in which the door rotates while protruding, and thus the structure positioned next to the side of the refrigerator is not positioned in a radius of rotation of the door, and the door may rotate without interference. In addition, hinge covers which move in conjunction with the movement of the hinge units are provided at one sides of the hinge units. When the hinge units protrude due to the opening of the door, since protrusions of the hinge units are provided not to be exposed by one ends of the hinge covers sliding.

22 Claims, 14 Drawing Sheets

(51) Int. Cl.
*E05D 3/08* (2006.01)
*E05D 7/04* (2006.01)
*E05D 11/00* (2006.01)

(58) Field of Classification Search
CPC .... E05D 7/04; E05D 3/08; E05D 3/14; E05D 3/16; E05Y 2900/31
USPC ..... 312/405, 326, 328, 325, 327
See application file for complete search history.

(56) References Cited

U.S. PATENT DOCUMENTS 5,056,192 A * 10/1991 Grass ..... E05D 11/0054 16/251
5,497,534 A * 3/1996 Caruso ..... E05D 3/06 16/288
7,350,273 B1 * 4/2008 Skipper ..... E05D 3/16 16/366
7,987,558 B2 8/2011 Beckmann et al.
9,388,616 B2 * 7/2016 Cooper ..... E05D 11/0054
2005/0241105 A1 * 11/2005 Wiley ..... E05D 3/16 16/266
2009/0064463 A1 * 3/2009 Gomoll ..... E05D 3/16 16/371
2011/0089801 A1 * 4/2011 Bonomie ..... E05D 3/14 312/405
2012/0032572 A1 * 2/2012 Lee ..... F25D 23/028 312/405
2013/0049562 A1 * 2/2013 Jung ..... F25D 23/028 312/405
2014/0210328 A1 * 7/2014 Akalan ..... E05D 7/00 312/326

FOREIGN PATENT DOCUMENTS

DE 3028266 * 2/1982
DE 4418238 * 10/1995
DE 29709806 * 7/1997
EP 2869007 * 5/2015
FR 2535960 A1 5/1984
KR 20070101298 A 10/2007
WO 2013057746 * 4/2013
WO WO 2014/127846 A1 8/2014
WO WO 2014/154252 A1 10/2014

OTHER PUBLICATIONS

Foreign Communication from Related Counterpart Application; European Patent Application No. 15203164.7; Communication under Rule 71(3) EPC dated Jul. 20, 2017; 42 pages.

* cited by examiner

REFRIGERATOR

CROSS-REFERENCE TO RELATED APPLICATIONS AND CLAIM OF PRIORITY

This application claims the benefit of Korean Patent Application No. 10-2015-0000551, filed on Jan. 5, 2015 in the Korean Intellectual Property Office, the disclosure of which is incorporated herein by reference.

TECHNICAL FIELD

Embodiments of the present disclosure relate to a hinge of a refrigerator door.

BACKGROUND

Generally, refrigerators are home appliances which include main bodies having inner cases and outer cases, storage compartments formed by the inner cases, and cold air supplying units which supply cold air to the storage compartments to store food freshly.

A temperature of the storage compartment is maintained in a predetermined range desired for storing the food freshly.

Such a storage compartment of the refrigerator is provided so that a front thereof is open, and the open front is normally sealed by a door for maintaining the temperature of the storage compartment.

The door includes a door guard provided to store stored-products, and is rotatably coupled to main body by a hinge unit to easily open and close.

A door of a recently released refrigerator includes a door guard having large capacity to store lots of stored-products, or is provided in a type of a double door for a user's convenience, and thus the door is formed to have a thick overall width.

Accordingly, when the door rotates around a hinge axis to open, the door is interfered with by a structure positioned next to a side of the refrigerator. Particularly, in a built-in refrigerator, since a structure such as a wall is positioned next to a side of the refrigerator and coplanar to an outline of the door of the refrigerator, there is a problem in that the door is interfered with by the structure while opening.

SUMMARY

Therefore, it is an aspect of the present disclosure to provide a refrigerator in which a door is opened and is not interfered with by a structure positioned at a side of the main body of the refrigerator while the door is opening.

It is another aspect of the present disclosure to provide a refrigerator which prevents a user's fingers from being jammed by a hinge not being exposed when a door is opened.

Additional aspects of the disclosure will be set forth in part in the description which follows and, in part, will be obvious from the description, or may be learned by practice of the disclosure.

In accordance with one aspect of the present disclosure, a refrigerator includes a main body including a storage compartment, a door which opens or closes the storage compartment, and a hinge unit provided in the main body so that the door is rotatably coupled to the main body, wherein the hinge unit includes: a first fixed hinge axis portion and a second fixed hinge axis portion provided in the main body; a first movable hinge axis portion and a second movable hinge axis portion provided in the door; and a link portion provided to connect the first and second fixed hinge axis portions and the first and second movable hinge axis portions, wherein the link portion includes a first link member and a second link member which intersect each other, while the door is opening, the first link member and the second link member protrude to a front of the refrigerator in conjunction with an opening operation of the door, at least parts of the first link member and the second link member are provided to be positioned outside of a side of the main body.

The first link member may have one end rotatably coupled to the first fixed hinge axis portion, the link portion further may include a third link member having one end rotatably coupled to the second fixed hinge axis portion, and while the door is opening, one side of the third link member may rotate and contact an axis portion at which the first link member and the first fixed hinge axis portion are coupled to each other.

The one side of the third link member may be provided to have a recessed shape corresponding to a circumferential surface of the axis portion of the first link member.

The second fixed hinge axis portion may be positioned at a side closer to an inside of the storage compartment than the first fixed hinge axis portion, and when the door is opened, the first link member may rotate around the first fixed hinge axis portion as an axis from an opening of the storage compartment until the third link member contacts the axis portion of the first link member.

When the door is closed, the second movable hinge axis portion may be positioned to be closer to a side of the door which is adjacent to a rotational axis thereof than the first movable hinge axis portion, and the second link member may have both ends respectively and rotatably coupled to the other end of the third link member and the second movable hinge axis portion.

The link portion may further include a fourth link member which has both ends respectively and rotatably coupled to the other end of the first link member and the first movable hinge axis portion.

The refrigerator may further include a hinge cover provided at one side of the hinge unit to cover at least a part of the hinge unit in conjunction with the opening operation of the door while the door is opening.

When the door is closed, the hinge cover may be positioned in the main body, and while the door is opening, the hinge cover slides and protrudes toward an outside of the main body.

The hinge cover may include a first hinge cover which covers at least a part of the hinge unit provided between the door and the main body while the door is opening, and a second hinge cover which covers at least a part of the hinge unit provided in the door while the door is opening.

The second hinge cover may include two panels which face each other and are apart from each other, two connection portions which respectively extend from the panels to connect both ends of the two panels, and are provided to have an arc shape, and a rotating portion which is coupled to the door and has a cylindrical shape so that the second hinge cover is rotatably coupled to the door.

The first hinge cover may be provided to have a panel shape, one end of the first hinge cover may include a first sliding portion which has a cylindrical shape and is provided to be slidable in the main body so that the hinge cover slides from an inside of the main body to protrude, and the other end of the first hinge cover may include a second sliding portion provided to slide between the panels of the second hinge cover.

The main body may include a first hinge housing which is opened toward the door and wherein a part of the hinge unit is provided in the first hinge housing, and the first hinge housing may include a guide portion which guides the first sliding portion.

The guide portion may include a stopping member provided at an opened side of the first hinge housing to restrain a sliding of the first sliding portion, and when the first sliding portion contacts the stopping member, the first hinge cover may be provided to be rotatable around the first sliding portion as an axis.

The second sliding portion may be connected to an extending protrusion which extends from one side of the first hinge cover, may be provided to be apart from the second hinge cover, may be inserted into the two panels of the second hinge cover, and may be provided to slide from one connection portion provided at one side to the other connection portion provided at the other side while the door is opening or closing.

The second sliding portion may be provided to have a cylindrical shape corresponding to a circumferential surface of the connection portion, and provided so that the first and second hinge covers are rotatable when the second sliding portion slides from the one connection portion provided at one side to the other one connection portion provided at the other side and contacts one side of the other one connection portion provided at the other side.

The door may include a second hinge housing opened toward the main body and an outer side of the door and wherein a part of the hinge unit is provided in the a second hinge housing, the rotating portion may be provided at one side of the second hinge housing opened toward the main body, and the second hinge cover may be provided to correspond to the one opened side of the second hinge housing to rotate around the rotating portion as an axis, and to cover the one side of the second hinge housing opened toward the main body while the door is opening.

The second hinge cover may include upper and lower covers which are bent at an upper end of the second hinge cover and extend to cover upper and lower portions of a part of the hinge unit.

The first hinge housing may further include an auxiliary cover in an outer direction of one opened side of the first hinge housing to cover the upper and lower portions of the part of the hinge unit outside of the one opened side of the first hinge housing.

The door may include an external door which opens or closes an outer side of the door, and one side of the hinge unit may further include an external door hinge provided so that the external door is rotatably coupled to the door.

In accordance with another aspect of the present disclosure, a refrigerator includes a main body including a storage compartment, a door which opens or closes the storage compartment, a hinge unit which is provided in the main body so that the door is rotatably coupled to the main body, and includes a plurality of hinge axis portions and a link portion, and a hinge cover provided at one side of the hinge unit to cover at least a part of the hinge unit in conjunction with an opening operation of the main body, wherein, in the hinge unit, the link portion is rotatably coupled to the plurality of hinge axis, while the door is opening, the link portion rotates in conjunction with each other, and the door protrudes to a front of the storage compartment, and rotates around the hinge unit as a rotational axis.

The link portion may include a first link member and a second link member which intersect each other, and may be provided so that while the door is opening, the first link member and the second link member protrude to a front of the refrigerator in conjunction with the opening operation of the door, and at least parts of the first link member and the second link member are positioned outside of a side of the main body.

The first link member and the second link member may perform a scissors movement and protrude to a front of the main body.

The hinge unit may include a first fixed hinge axis portion provided in the main body and a second fixed hinge axis portion positioned closer to an inside of the storage compartment than the first fixed hinge axis portion, the link portion may include a third link member having one end rotatably coupled to the second fixed hinge axis portion, the first link member may have one end rotatably coupled to the first fixed hinge, and when the door is opening, one end of the third link member may rotate and contact an axis portion at which the first link member and the first fixed hinge axis portion are coupled to each other.

One side of the third link member may be provided to have a recessed shape corresponding to a circumferential surface of the axis portion of the first link member.

When the door is closed, the hinge cover may be positioned in the main body, and while the door is opening, the hinge cover may slide and protrude to an outside of the storage compartment.

The hinge cover may include a first hinge cover which covers a part of the hinge unit provided between the door and the main body while the door is opening, and a second hinge cover which covers a part of the hinge unit provided in the door while the door is opening, wherein the second hinge cover is provided to be slidable around one side of the first hinge cover as a center.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
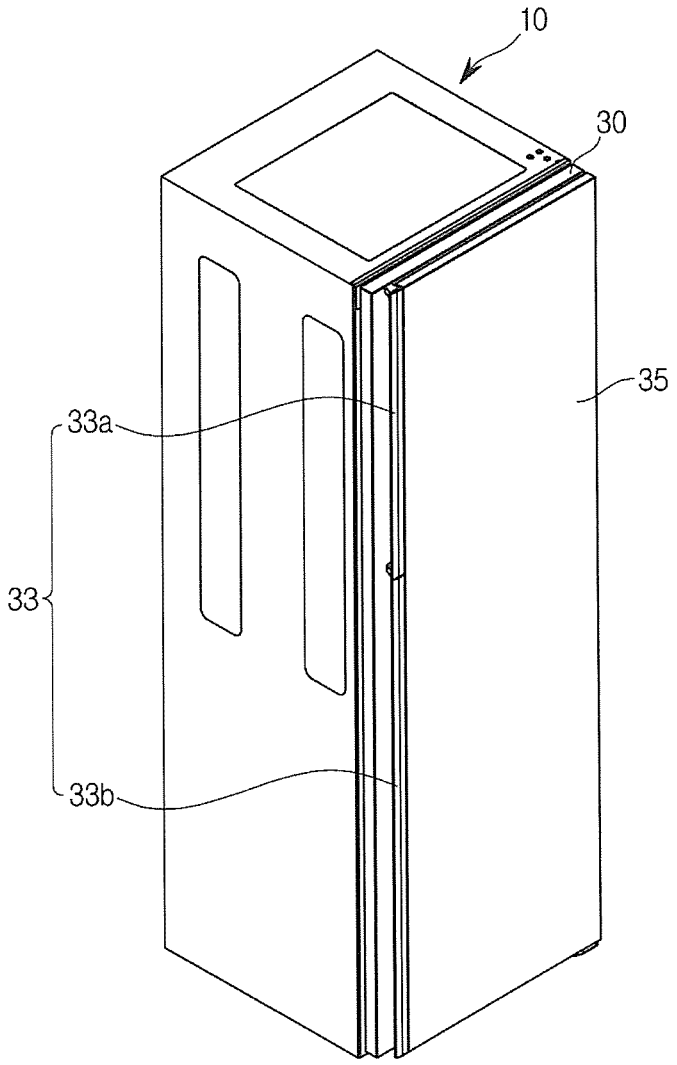
FIG. 1 is a perspective view illustrating a refrigerator according to one embodiment of the present disclosure.

Reference will now be made in detail to the embodiments of the present disclosure, examples of which are illustrated in the accompanying drawings, wherein like reference numerals refer to like elements throughout.

Hereinafter, embodiments of the present disclosure will be described in detail with reference to following drawings.

As illustrated in FIGS. 1 to 4, a refrigerator includes a main body 10, a storage compartment 20 provided so that a front thereof is open in the main body 10, a door 30 which opens or closes the storage compartment 20, and a cold air supply unit which supplies cold air to the storage compartment 20.

The main body 10 is generally formed in a box shape, and includes an inner case 11 which forms the storage compartment 20, an outer case 13 which is coupled to an outer side of the inner case 11 to form an exterior, and an insulation member (not shown) provided between the inner case 11 and the outer case 13.

The inner case 11 may be provided to include a resin material, and the outer case 13 may be provided to include a steel material.

The cold air supply unit may include a compressor (not shown), a condenser (not shown), an expansion valve (not shown), and an evaporator (not shown), may circulate a refrigerant, and may generate cold air using latent heat from evaporation.

The storage compartment 20 may include a shelf 22 which stores stored-products, and an opening 21 of which a front is open, and may be opened or closed by the door 30.

The storage compartment 20 is not limited to one embodiment of the present disclosure, and is divided into a freezer compartment which is one side divided by a vertical partition, and a refrigerator compartment which is the other side. In addition, the door 30 may be provided to include a freezer compartment door and a refrigerator compartment door to respectively open or close the freezer compartment and the refrigerator compartment.

The door 30 may be rotatably provided in a front of the main body 10 by hinge units 100 coupled to an upper portion and a lower portion of the main body 10.

A door opening 31 provided to have a size slightly less than that of the storage compartment 20 may be provided in the door 30, and a plurality of door guards 32 formed to have various sizes may be provided in the door opening 31.

The door opening 31 provided in the door 30 is opened or closed by an external door 35. The external door 35 may be rotatably provided in a front of the door 30, and may be rotatably provided in the same direction as a rotational direction of the door 30.

Rotational axes of the door 30 and an external door 35 are horizontal to each other, but the rotational axes are not positioned on the same axis. The rotational axes of the door 30 and the external door 35 will be described in detail later.

A handle 33 by which a user grips and opens or closes the door 30 is provided on the door 30. The handle 33 includes an external door handle 33*a* which is connected to a side surface of the external door 35 and only involved in opening and closing of the external door 35, and a door handle 33*b* which is connected to a side surface of the external door 35 and one side of a front portion of the internal door 30, and opens the door 30 in a state in which the external door 35 is in contact with the door 30.

The external door handle 33*a* and the door handle 33*b* are provided to be parallel in a vertical direction, and the door handle 33*b* is provided above the external door handle 33*a*.

The external door 35 may not include an opening, and may have a substantially planar shape to open or close the door opening 31 of the door 30.

As illustrated in FIG. 1, when the door 30 and the external door 35 are closed, the storage compartment 20 is sealed, and cold air of the storage compartment 20 may be maintained through operation of the door 30 and the external door 35.

Figure 2:
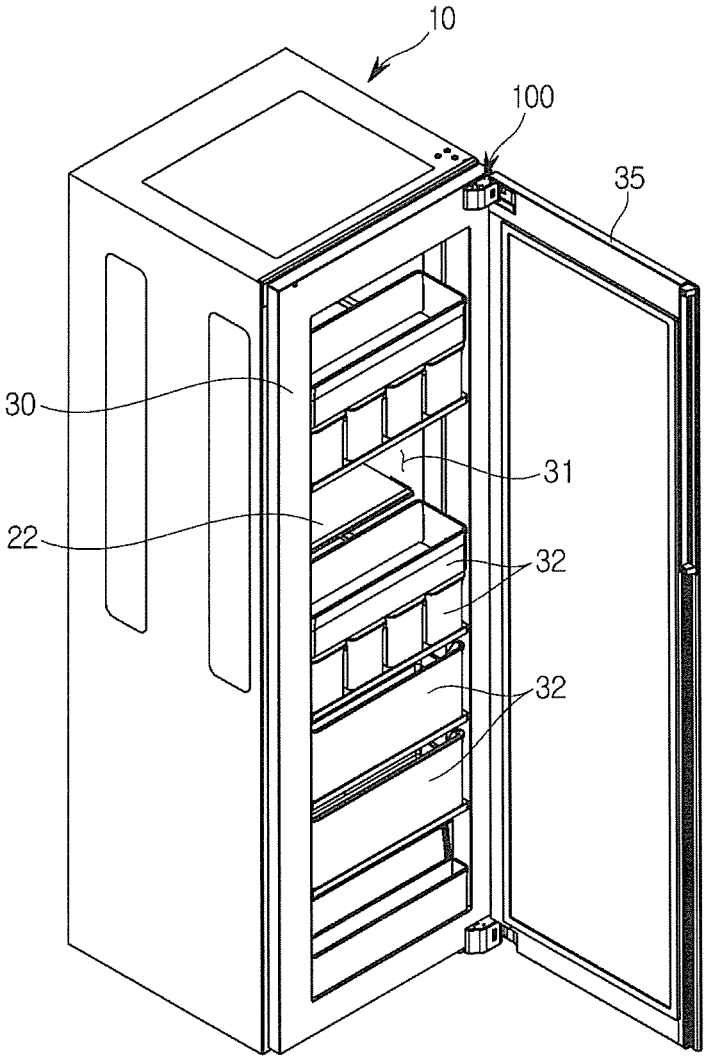
FIG. 2 is a perspective view of an opened state of a door of the refrigerator according to one embodiment of the present disclosure opens.

As illustrated in FIG. 2, when the external door 35 is opened, a user may approach at least one door guard 32 to put in or take out stored-products which are stored therein.

At this time, leakage of the cold air from the storage compartment 20 may be decreased compared to that of when the door 30 is opened.

Figure 3:
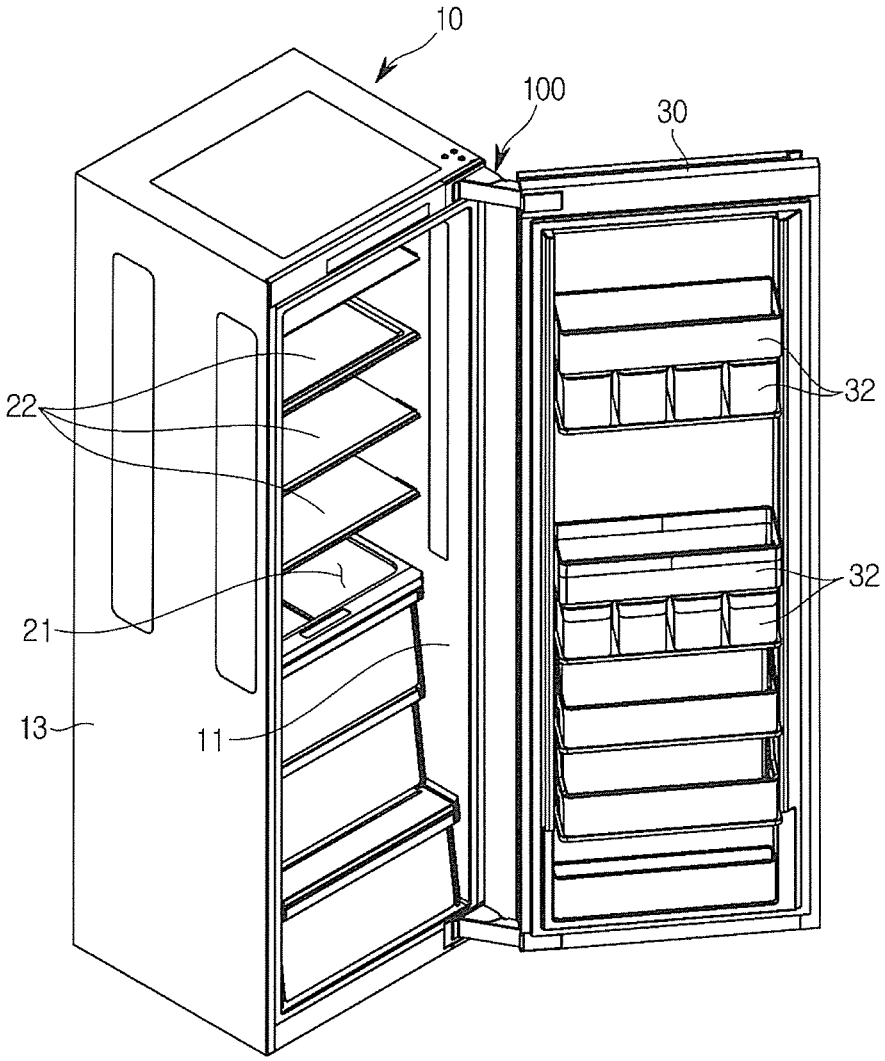
FIG. 3 is a perspective view of an opened state of an external door of the refrigerator according to one embodiment of the present disclosure.

As illustrated in FIG. 3, when the door 30 is opened, the user may approach an inside of the storage compartment 20 to put in or take out stored-products which are stored on the shelf 22, and may also approach to at least one door guard 32 to also put in or take out stored-products which are stored in the at least one door guard 32.

As describe above, the refrigerator according to one embodiment of present disclosure has the effect that it is possible to put in or takeout food in various manners according to a user's necessity and it is possible to minimize the leakage of cold air.

The door 30 and the main body 10 are coupled to each other by the hinge units 100. The hinge units 100 are respectively provided at the upper portion and the lower portion of the main body 10. In addition, the hinge units 100 positioned at the upper portion and the lower portion are coupled to corresponding sides of the door 30 so that the door 30 is rotatable around the main body.

Figure 4:
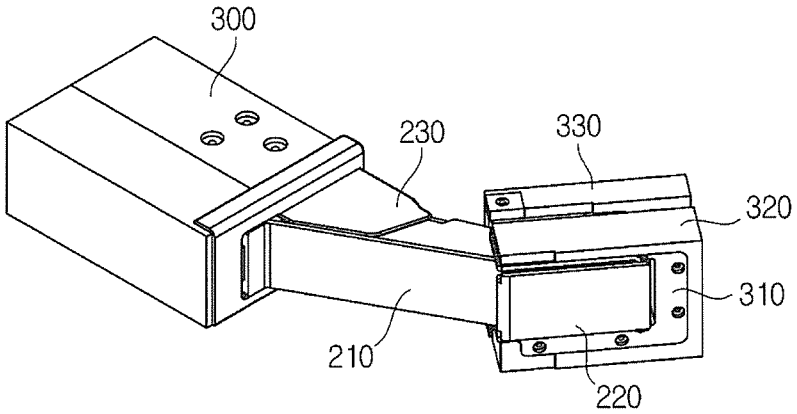
FIG. 4 is an enlarged view illustrating a hinge unit and a protection cover according to one embodiment of the present disclosure.

When the door 30 is closed, the hinge unit 100 is inserted into the main body 10*b*, and while the door 30 is opening, the hinge unit 100 protrudes forward from the main body 10 and is positioned outside of a side portion of the main body 10 according to an opening operation of the door 30. At this time, as illustrated in FIG. 4, at least a part of the hinge unit 100 is covered by a hinge cover 200 which will be described later.

Hereinafter, the hinge units 100 will be described in detail. In addition, since the hinge units 100 provided at the upper portion and the lower portion are identically provided to each other and are provided to correspond to the same axis, only the hinge unit 100 provided at the upper portion will be described.

As illustrated in FIGS. 5 to 9, the hinge unit 100 includes a fixed bracket 110 provided at the main body 10, and a first fixed hinge axis portion 111 and a second fixed hinge axis portion 112 positioned at the fixed bracket 110.

A part of the fixed bracket 110 may be provided to be inserted into a first hinge housing 300. As illustrated in FIG. 3, the first hinge housing 300 may be positioned at an upper end of the storage compartment 20, and may be provided in the main body 10.

The first hinge housing 300 may be provided to have a rectangular shape opened toward the front of the main body 10, and a space into which the fixed bracket 110 and the hinge cover 200 are insertable may be provided thereinside.

The fixed bracket 110 may be provided to have a trapezoidal shape. One side of the fixed bracket 110 which has a larger planar area may be provided in the first hinge housing 300 and may be coupled and fixed by a bolt or the like.

The other side which includes an inclined portion of the fixed bracket 110 and has a smaller planar area may be provided to protrude forward from the main body 10, and the first fixed hinge axis portion 111 and the second fixed hinge axis portion 112 may be provided in a protrusion of the fixed bracket 110.

The first fixed hinge axis portion 111 and the second fixed hinge axis portion 112 may include holes so that a link portion 150 is rotatably joint coupled.

The first and second fixed hinge axis portions 111 and 112 may be disposed to be perpendicular to a side of the opening 21. In addition, the second fixed hinge axis portion 112 may be positioned closer to the opening 21 than the first fixed hinge axis portion 111.

The hinge unit 100 may further include movable brackets 120 positioned at the door 30 and provided to correspond to the fixed bracket 110.

A pair of movable brackets 120 may be vertically and symmetrically provided, and a pair of first movable hinge axis portions 121 and a pair second movable hinge axis portions 122 may be respectively provided at corresponding positions of the pair of movable brackets 120. The first and second movable hinge axis portions 121 and 122 may respectively include grooves so that the link portion 150 is rotatably joint coupled thereto.

The second movable hinge axis portion 122 may be provided to be closer to a side portion adjacent to the hinge unit 100 of the door 30 than the first movable hinge axis portion 121 in a state in which the door 30 is closed.

The movable bracket 120 may be not limited to the present embodiment, and may be provided to have a single plate shape like the fixed bracket 110. When the movable bracket 120 is provided singularly, the first and second movable hinge axis portions 121 and 122 may include holes to be joint coupled to the movable bracket 120.

The movable bracket 120 is coupled to an inside of a second hinge housing 310 by a bolt or the like. The second hinge housing 310 may be positioned at a side of the door 30 toward the main body 10, and may be provided to correspond to the first hinge housing 300.

The second hinge housing 310 may be provided to be opened toward the main body 10 and an outer side of the main body 10, and a space into which at least parts of the movable bracket 120 and the link portion 150 are insertable may be provided in the second hinge housing 310.

The second hinge housing 310 may be provided to protrude from forward of the door 30 to extend to a side of the external door 35. At this time, an external surface of the second hinge housing 310 provided at the side of the door 30 is protected by a first door cover 320 provided at the door 30, and an external surface of the second hinge housing 310 provided at a side of the external door 35 is protected by a second door cover 330 provided at the external door 35.

The second door cover 330 may include a space capable of accommodating the second hinge housing 310 which protrudes inward. Preferably, the space may be provided to have a shape corresponding to an outline of the protruding second hinge housing 310.

The first and second fixed hinge axis portions 111 and 112 and the first and second movable hinge axis portions 121 and 122 may be coupled by the link portion 150 including a plurality of link members 151, 152, 153, and 154.

The link members 151, 152, 153, and 154 may be provided to have a stick shape having four sides, and holes having a cylindrical shape may be vertically included in both ends thereof to joint couple. Short sides positioned at both ends of the link members 151, 152, 153, and 154 may be formed to be rounded to have arc shapes so as to correspond to circumferential surfaces of the holes.

The both ends of the link members 151, 152, 153, and 154 are joint coupled to the hinge axis portions 111, 112, 121, and 122 or other link members, and thus the link members 151, 152, 153, and 154 may rotate.

The link portion 150 may include first link members 151 and a second link member 152 which are disposed to intersect each other. The first link members 151 and the second link member 152 may respectively include intersect portions 151*a* and 152*a* which are rotatably and jointly coupled.

The first and second link members 151 and 152 may protrude forward from the main body 10 while performing a scissors movement around the intersect portions 151*a* and 152*a* as axes in conjunction with an opening operation of the door 30.

The link portion 150 may not be limited to one embodiment of the present disclosure, and may include one or more intersect portions. Accordingly, the link portion 150 may include two or more link members disposed to intersect each other.

When the intersect portion is provided in a plural number, the hinge unit 100 may protrude more forward from the main body 10 than the present embodiment, and thus the door 30 may further protrude.

A pair of first link members 151 may be provided to be apart from each other by a thickness of the fixed bracket 110. One ends of the pair of first link members 151 may be respectively positioned to correspond to an upper end and a lower end of the first fixed hinge axis portion 111.

Holes provided in the one ends of the pair first link members 151 may be positioned to correspond to a hole of the first fixed hinge axis portion 111, and may be joint coupled thereto by a pin or the like. Accordingly, the pair of first link members 151 may pivot around the first fixed hinge axis portion 111 as a rotational axis.

The second link member 152 may be provided between the pair of first link members 151 to intersect the pair of first link members 151. The first link members 151 and the second link member 152 may be rotatably provided by the intersect portions 151*a* a and 152*a* provided at a center portion being joint coupled to each other as described above.

One end of the second link member 152 may be rotatably provided by being joint coupled to the second movable hinge axis portion 122. That is, one end of the second link member 152 may be positioned between the pair of movable brackets 120, and grooves of the pair of second movable hinge axis portions 122 and a hole provided at the one end of the second link member 152 may be positioned to correspond to each other, and may be rotatably coupled to each other by a pin or the like.

The other end of the second link member 152 may be rotatably joint coupled to the other end of the third link member 153 whose one end is coupled to the second fixed hinge axis portion 112.

A pair of third link members 153 may be provided to be apart from each other by a thickness of the fixed bracket 110. One ends of the pair of third link members 153 may be positioned to correspond to an upper end and a lower end of the second fixed hinge axis portion 112.

Holes provided in one ends of the pair of third link members 153 may be positioned to correspond to a hole of the second fixed hinge axis portion 112, and may be joint coupled by a pin or the like. Accordingly, the pair of third link members 153 may pivot around the second fixed hinge axis portion 112 as a rotational axis.

As described above, the other end of the second link member 152 may be positioned between the pair of third link members 153. The holes provided in the other ends of the pair of third link members 153 and the hole provided in the other end of the second link member 152 may be positioned to correspond to each other, and may be rotatably coupled to each other.

The other ends of the pair of first link members 151 may be connected to the first movable hinge axis portion 121 by a fourth link member 154.

That is, one end of the fourth link member 154 may be positioned between the other ends of the pair of first link members 151, and grooves provided in the other ends of the pair of first link members 151 and a groove provided in one end of the fourth link member 154 may be provided at a corresponding position, and may be rotatably coupled to each other by a pin or the like.

In addition, the other end of the fourth link member 154 may be positioned to correspond to the first movable hinge axis portion 121. That is, the other end of the fourth link member 154 may be positioned between the pair of movable brackets 120, and grooves of the pair of first movable hinge axis portions 121 and a hole provided in the other end of the fourth link member 154 may be provided to correspond to each other, and may be coupled to each other by a pin or the like.

As described above, both ends of the plurality of link members 151, 152, 153, and 154 of the link portion 150 may be rotatably provided, each of the link members may rotate according to the opening operation of the door 30, and thus the door 30 may protrude forward from the main body 10, and may rotate toward the outer side of the main body 10.

Figure 5:
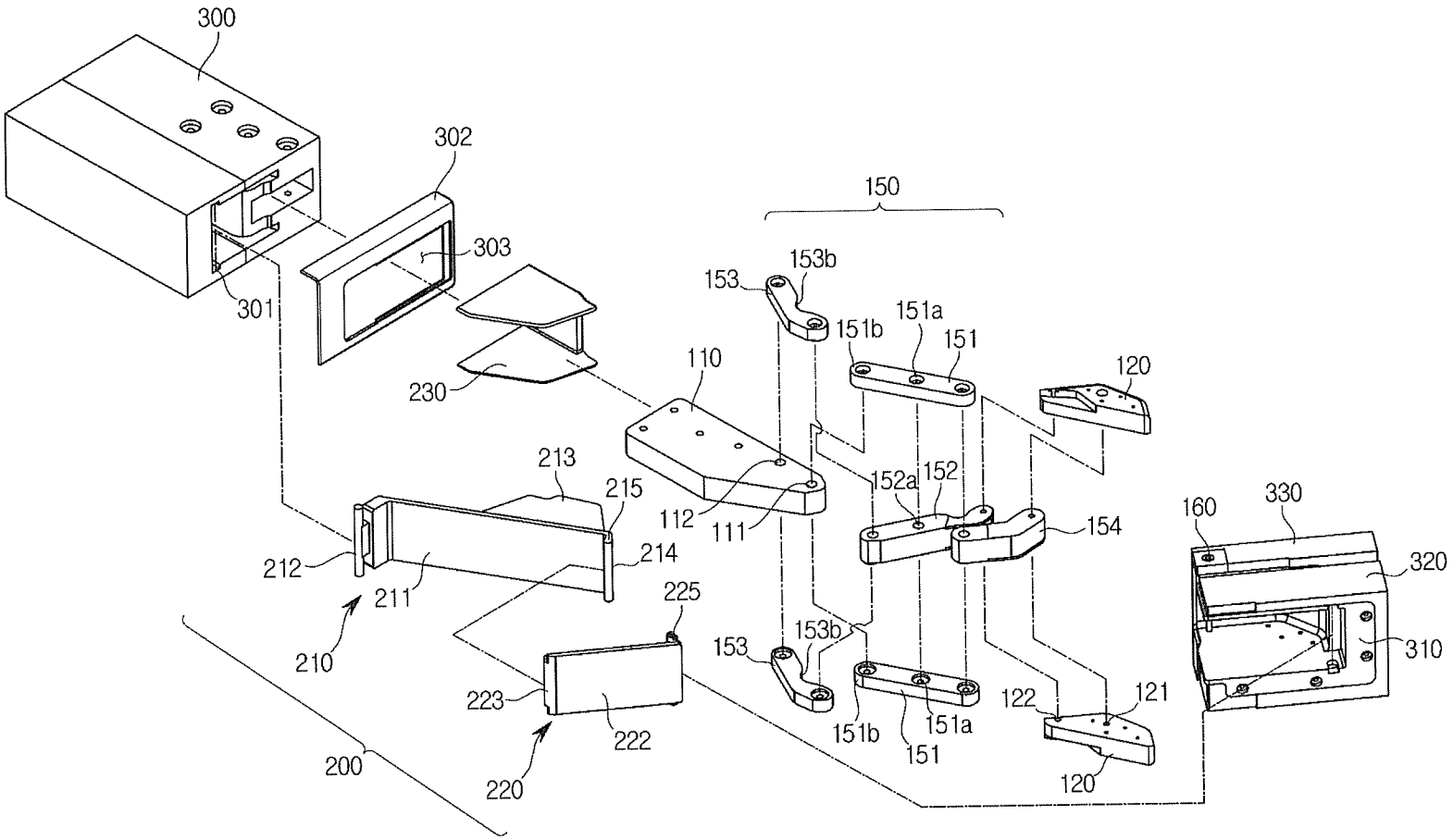
FIG. 5 is an exploded perspective view illustrating the hinge unit according to one embodiment of the present disclosure.
Figure 14:
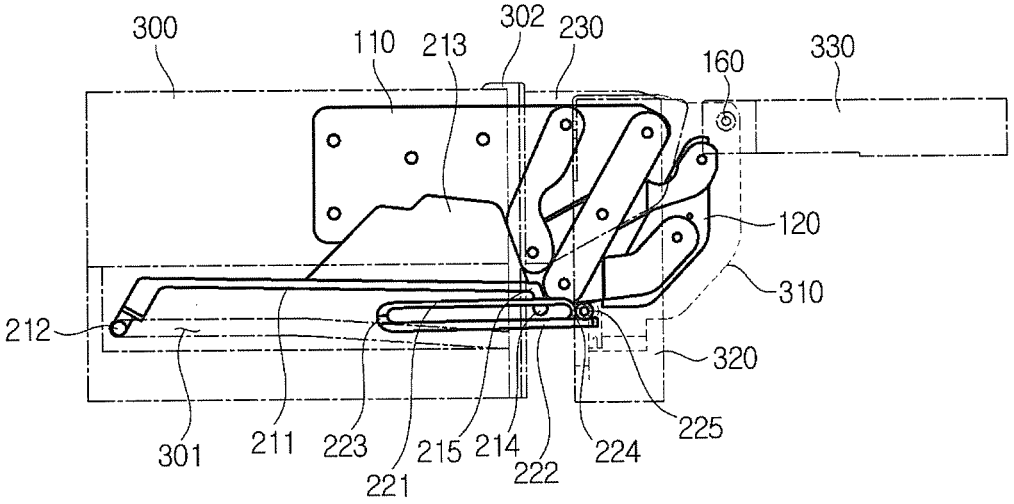
FIG. 14 is a view illustrating the operation of the hinge unit and the hinge cover while opening the external door according to one embodiment of the present disclosure.

As illustrated in FIGS. 5 and 14, the hinge unit 100 may include an external door hinge axis portion 160 which connects the door 30 and the external door 35 so that the external door 35 is rotatably coupled to the door 30.

The external door hinge axis portion 160 may be provided at a side of the second hinge housing 310 which protrudes from the external door 35.

Specifically, one side of the second hinge housing 310 including a movable bracket 120 may be provided to protrude inward from the second door cover 330, and the external door hinge axis portion 160 may be provided to be adjacent to one side of the movable bracket 120 which protrudes inward from the second door cover 330.

Since the external door hinge axis portion 160 is provided to be apart from the movable bracket 120 and the link portion 150, the external door 35 may independently rotate without being interfered with by the opening operation of the door 30.

Hereinafter, an operation of the hinge unit 100 while the door 30 is opening will be described in detail.

Figure 6:
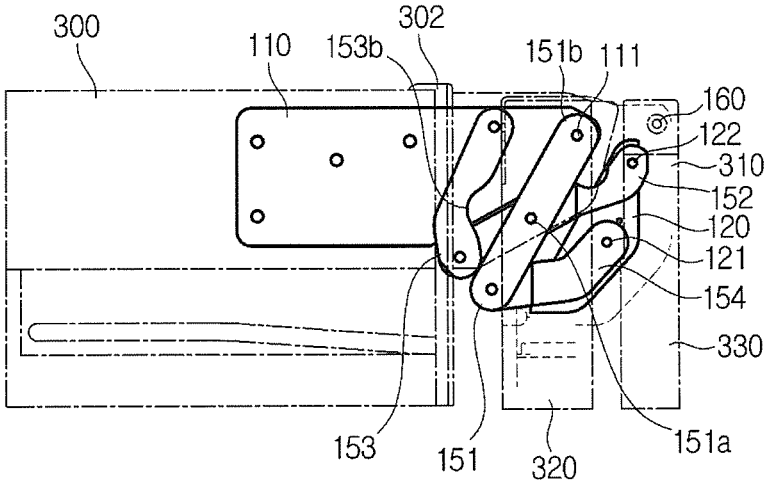
FIG. 6 is a view illustrating the operation of the hinge unit while closing of the door according to one embodiment of the present disclosure.
Figure 7:
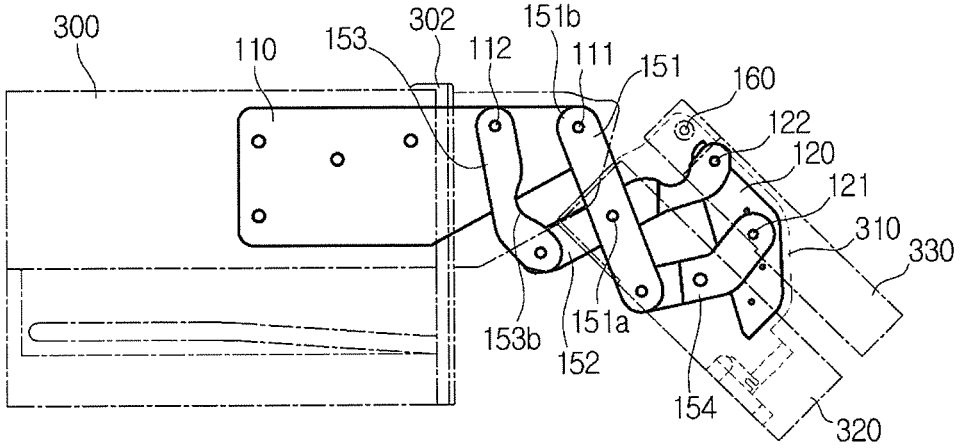
FIG. 7 is a view illustrating the operation of the hinge unit while opening the door according to one embodiment of the present disclosure.

As illustrated in FIGS. 5 and 6, when the door 30 is closed, the plurality of link members 151, 152, 153, and 154 may be positioned to be adjacent to the main body 10, and a part thereof may be inserted into the second hinge housing 310.

While a user is opening the door 30, a force may press the door 30 forward from the main body 10, the force may press the first and second movable hinge axis portions 121 and 122, the force may be transferred to one sides of the second and fourth link members 152 and 154 connected to the first and second movable hinge axis portions 121 and 122, and thus the second and fourth link members 152 and 154 may protrude forward from the main body 10.

In addition, simultaneously, one ends of the third and first link members 153 and 151 may be respectively rotatably coupled to the second and fourth link members 152 and 154, and the second and fourth link members 152 and 154 may partially rotate in a direction in which the door 30 is opened.

As the second and fourth link members protrude, when a force is transferred to the one ends of the third and first link members 153 and 151 respectively connected to the other ends of the second and fourth link members 152 and 154, the first and third link members 151 and 153 may respectively rotate around the first and second fixed hinge axis portions 111 and 112 as rotational axes in the direction in which the door 30 rotates, and may protrude forward from the main body 10.

Figure 8:
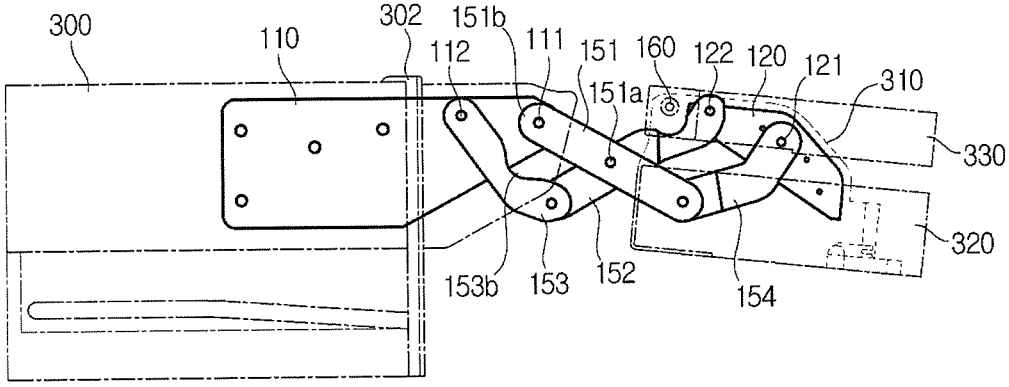
FIG. 8 is a view illustrating the operation of the hinge unit while opening the door according to one embodiment of the present disclosure to an angle of 90°.

As illustrated in FIG. 8, while the door 30 is opening to be perpendicular to the main body 10, the first and second link members 151 and 152 may perform the scissors movement, the second and fourth link members 152 and 154 may protrude forward from the main body 10, the first and third link members 151 and 153 may respectively rotate around the first and second fixed hinge axis portions 111 and 112 as rotational axes and may protrude forward from the main body 10, and thus the door 30 may be apart from the main body 10 and may rotate.

Figure 9:
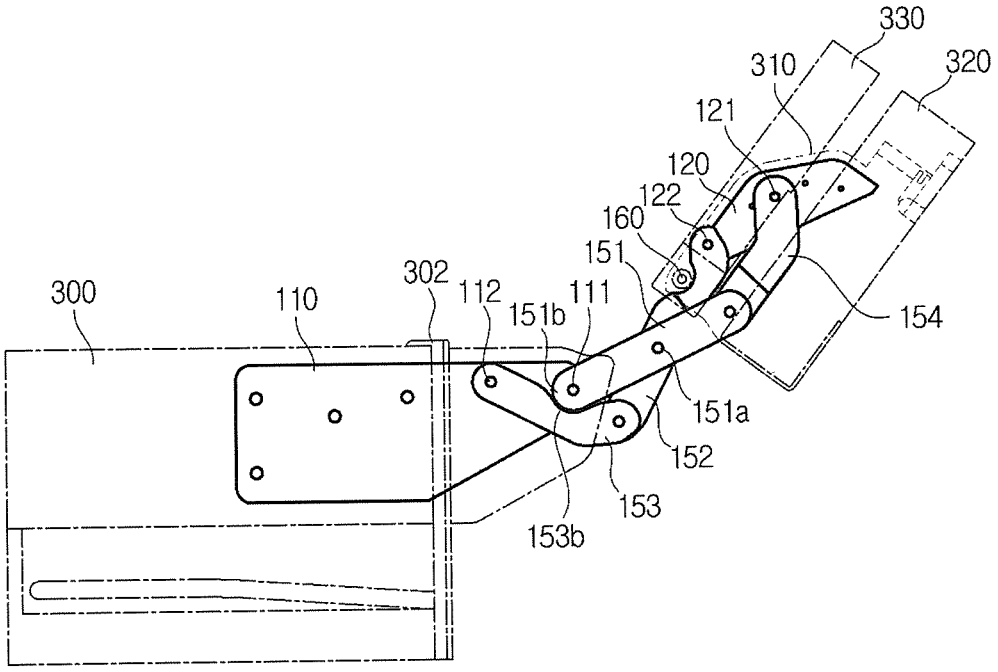
FIG. 9 is a view illustrating the operation of the hinge unit while opening the door according to one embodiment of the present disclosure to a maximum angle.

As illustrated in FIG. 9, when the door 30 is opened to an angle of 90° or more with respect to the main body 10, the second and fourth link members 152 and 154 may respectively rotate around one ends of the third and first link members 153 and 151 as rotational axes in the direction in which the door 30 is opened.

In addition, the first and third link members 151 and 153 may also further rotate around the first and the second fixed rotational axis portions 111 and 112 as rotational axes in the direction in which the door 30 is opened.

The door 30 may rotate at a greater angle with respect to the main body 10 as the first and third link members 151 and 153 rotates in the direction in which the door 30 rotates. Particularly, the door 30 may rotate until the third link members 153 rotate to contact one end of the first link members 151.

Accordingly, for increasing a rotation angle of the door 30, a contact portion **153*b* which is provided to have a recessed shape corresponding to circumferential surfaces of an axis portion 151*b* in which first fixed hinge portions of the first link members 151 are positioned may be provided at one sides of the third link members 153**.

The contact portion **153*b* is provided to further increase a rotation angle of the third link members 153 until the third link members 153 contact the first link members 151. As the rotation angle of the third link member 153 increases, the rotation angle of the door 30 increases, and thus the door 30 may sufficiently rotate with respect to the main body 10**.

When the main body 10 is provided in a built-in manner, since structures such as furniture or kitchen utensils may be formed next to a side of the main body 10, while the door 30 is opening, the structures may be positioned in a radius of rotation of the door 30, which may interfere with the opening of the door 30. However, as described above, when the door 30 is opened while protruding by the link portion 150, since the radius of rotation of the door 30 is formed to protrude forward from the main body 10, the door 30 may be opened without interfering with the structures positioned next to the side of the main body 10.

Hereinafter, the hinge cover which covers the hinge unit 100 exposed toward an outer side of the main body 10 when the hinge unit 100 protrudes may be described in detail.

As illustrated in FIGS. 4 to 5 and FIGS. 10 to 13, while the door 30 is opening, the hinge cover 200 may be provided in a direction in which the hinge unit 100 rotates to cover at least a part of the hinge unit 100 in conjunction with an opening operation of the door 30.

When the door 30 is closed, the hinge cover 200 is positioned in the first hinge housing 300, and while the door 30 is opening, the hinge cover 200 may slide to protrude toward an outside of the main body 10 in conjunction with the opening operation of the door 30.

The hinge cover 200 may include a first hinge cover 210 which covers a part of the hinge unit 100 provided between the door 30 and the main body 10 while the door 30 is opening, and a second hinge cover 220 which covers a part of the hinge unit 100 provided in the door 30 when the door 30 is opened.

The first hinge cover 210 may include a cover portion 211 which has a panel shape and covers a side portion of the hinge unit 100 toward a rotation direction of the door 30, and a first sliding portion 212 provided at one end of the first hinge cover 210 so that the hinge cover 200 slides from an inner side of the first hinge housing 300 toward an outer side thereof.

The first sliding portion 212 may be provided to have a cylindrical shape, and may be bent at one side of the cover portion 211 to extend.

A guide portion 301 which guides the sliding of the first sliding portion 212 may be included in the first hinge housing 300. The guide portion 301 may be provided to have a lengthy groove corresponding to an upper end and a lower end of the first sliding portion 212.

A bent portion may be included in a middle of the guide portion 301 so that the first hinge cover 210 and the second hinge cover 220 positioned at a side of the first hinge cover 210 are inserted into the first hinge housing 300 when the door 30 is closed.

A stopping member 302 which restrains the sliding of the first sliding portion 212 may be included at one side of the first hinge housing 300 which is opened.

The stopping member 302 is positioned in a direction in which the guide portion 301 is opened toward the front, and prevents the first sliding portion 212 from moving out of the guide portion 302.

The stopping member 302 may be provided to have a frame type including an open portion 303. The open portion 303 of the stopping member 302 is provided so that the hinge cover 200 and the link portion 150 pass through.

When the sliding of the first sliding portion 212 is restrained by the stopping member 302, the first sliding portion 212 may perform a function of a rotational axis so that the hinge cover 200 moves in conjunction with the opening and closing operation of the door 30.

Upper and lower covers 213 which are perpendicularly bent at the cover portion 211 to extend may be provided at an upper end and a lower end of the cover portion 211. Since the cover portion 211 is formed to have a panel shape parallel to the side portion of the hinge unit 100 to cover only one side of the hinge unit 100, the upper and lower covers 213 cover an upper portion and a lower portion of the hinge unit 100.

A second sliding portion 214 provided so that the second hinge cover 220 slides may be further included at the other end of the first hinge cover 210.

The second sliding portion 214 may be provided to be connected to an extending protrusion 215 which extends from one side of the cover portion 211 toward a side opposite to the hinge unit 100, and to be apart from the cover portion 211.

The second hinge cover 220 may include a first panel 221 provided to be adjacent to the hinge unit 100, a second panel 222 which faces and is parallel to the first panel 221 at a distance, a first connection portion 223 and a second connection portion 224 which connect the first and second panels 221 and 222, and a rotating portion 225 provided so that a second hinge cover 220 is rotatably coupled to the second hinge housing 310.

The second sliding portion 214 is inserted between the first and second panels 221 and 222, and thus the second hinge cover 220 may slide with respect to the first hinge cover 210.

The first panel 221 may be provided between a pair of extending protrusions 215 respectively connected to both ends of the second sliding portion 214. Accordingly, while the second hinge cover 220 is sliding, the first panel 221 may move back and forth between the pair of extending protrusions 215.

The second panel 222 may be provided to have a size corresponding to an opening of one side of the second hinge housing 310 which is opened toward the main body 10. Accordingly, when the door 30 is opened to a maximum angle, the one side of the second hinge housing 310 which is opened toward the main body 10 may be covered by the second panel 222.

The connection portions 223 and 224 may be provided to have an arc shape to correspond to a circumferential surface of the second sliding portion 214. In a state in which the door 30 is closed, the first connection portion 223 may be provided at a position which is further from the second hinge housing 310 among the two connection portions 223 and 224.

The second hinge cover 220 may slide as much as a distance which separates the first connection portion 223 and the second connection portion 224.

That is, when the door 30 is closed, the second sliding portion 214 is provided at a position adjacent to the second connection portion 224, the second hinge cover 220 slides with respect to the first hinge cover in conjunction with the movement of the door 30 when the door 30 is opened, and thus the second sliding portion 214 and the first connection portion 223 encounter each other.

The second sliding portion 214 may be provided so that the second sliding portion 214 finishes sliding when encountering the first connection portion 223, the first and second hinge covers 210 and 220 may move in conjunction with each other, and the first hinge cover 210 and the second hinge cover 220 may simultaneously rotate.

The rotating portion 225 in which the second hinge cover 220 and the second hinge housing 310 are rotatably coupled to each other may be provided at one side of the second connection portion 224.

The rotating portion 225 may be provided to have a cylindrical shape, and may be rotatably coupled to a groove provided in the second hinge housing 310 to correspond to upper and lower sides of the rotating portion 225.

Hereinafter, an operation of the hinge cover 200 while opening the door 30 will be described in detail.

Figure 10:
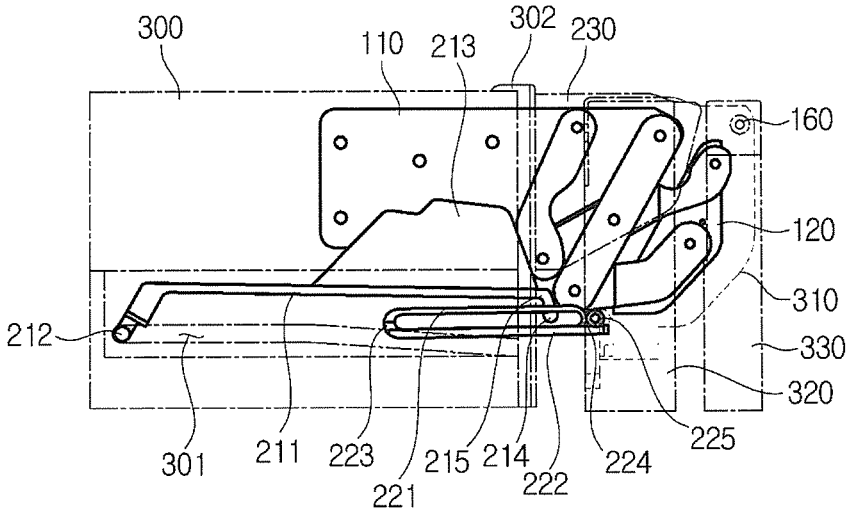
FIG. 10 is a view illustrating the operation of the hinge unit and a hinge cover while sealing the door according to one embodiment of the present disclosure.

As illustrated in FIG. 10, when the door 30 is closed, the hinge cover 200 may be inserted into the first hinge housing 300. The first sliding portion 212 may be positioned at one end of the guide portion 301, and the second sliding portion 214 may be positioned at a side adjacent to the second connection portion 224. When the door 30 is closed, the second hinge cover 220 may be provided at a side facing a side surface of the first hinge cover 210.

Figure 11:
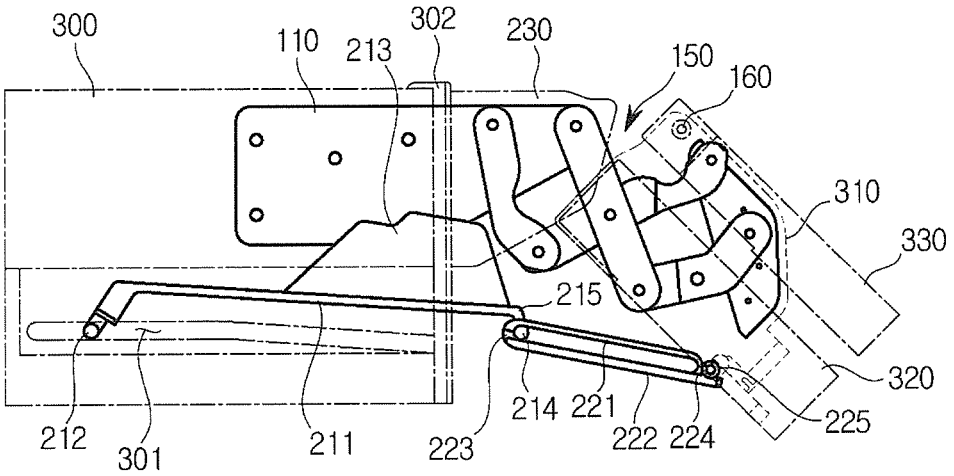
FIG. 11 is a view illustrating the operation of the hinge unit and the hinge cover while opening the door according to one embodiment of the present disclosure.

As illustrated in FIG. 11, while a user is pressing the door 30, a force is transferred to the rotating portion 225 rotatably coupled to the second hinge housing 310, and thus the second hinge cover 220 may protrude to the front of the main body 10.

At this time, the second hinge cover 220 may slide forward from the main body 10 with respect to the first hinge cover 210. The sliding of the second hinge cover 220 is finished when the second sliding portion 214 encounters the first connection portion 223.

When the sliding of the second hinge cover 220 is finished, the first and second hinge covers 210 and 220 maintain a state in which the second sliding portion 214 encounters the first connection portion 223, and the first and second hinge covers 210 and 220 may integrally protrude to the front of the main body 10.

Simultaneously, the first hinge cover 210 may protrude from the first hinge housing 300 along the guide portion 301, the second sliding portion 214 may be provided to be pivotable while the first and second hinge covers 210 and 220 are integrally moving, and thus each of the first and second hinge covers 210 and 220 may be rotatable.

Figure 12:
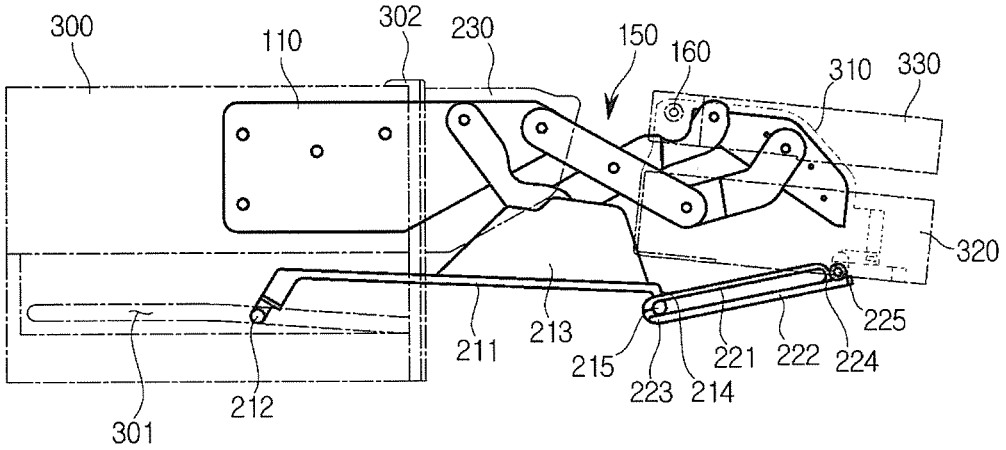
FIG. 12 is a view illustrating the operation of the hinge unit and the hinge cover opening the door according to one embodiment of the present disclosure to an angle of 90°.
Figure 13:
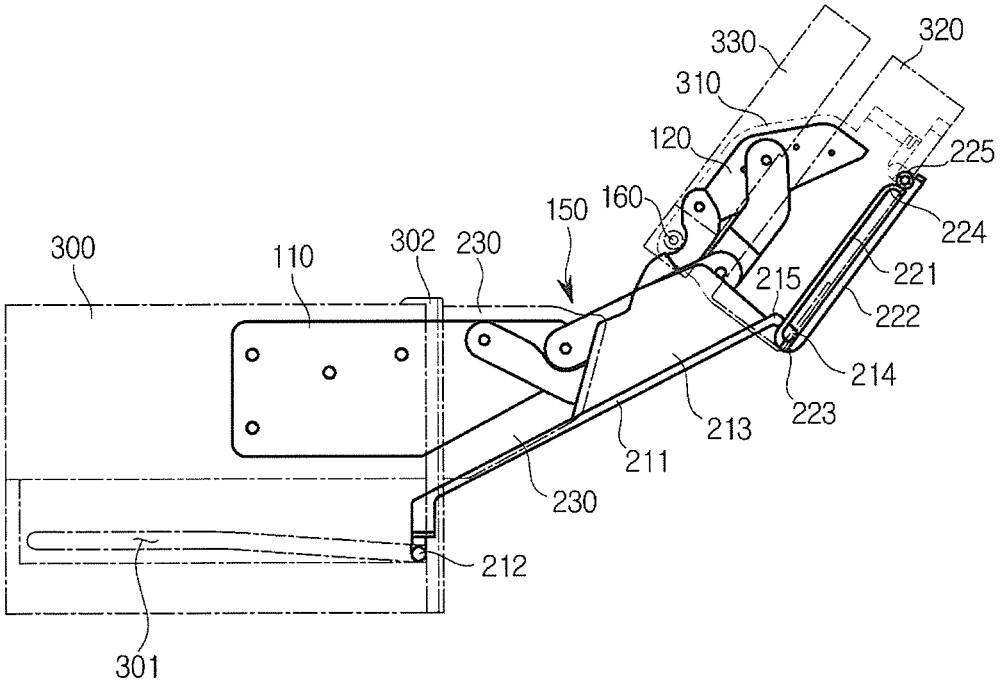
FIG. 13 is a view illustrating the operation of the hinge unit and the hinge cover while opening the door according to one embodiment of the present disclosure to a maximum angle.

As illustrated in FIGS. 12 to 13, when the door 30 is opened to around a right angle from a closed state, the first and second hinge covers 210 and 220 slide along a moving path of the rotating portion 225 to protrude to the front of the main body 10.

When the first sliding portion 212 contacts the stopping member 302, the first and second hinge covers 210 and 220 may finish sliding, and may rotate around the first sliding portion 212 as a rotational axis in a direction in which the door 30 is opened.

Since the second sliding portion 214 rotates in the direction in which the door 30 is opened, the first hinge cover 210 may be provided to be closer to the hinge unit 100. When the door 30 is opened to a maxim angle, the cover portion 211 may cover one entire side of the hinge unit 100 which protrudes between the main body 10 and the door 30.

In addition, as the upper and lower covers 213 protrude until the upper and lower covers 213 and an auxiliary cover 230 are positioned parallel to each other due to a movement of the first hinge cover 210, when the door 30 is opened to the maximum angle, the upper and lower covers 213 may cover the entire upper and lower portions of the hinge unit 100 which protrude between the main body 10 and the door 30.

When the door 30 rotates to an angle of 90° or more, a side of the first connection portion 223 may move toward a side of the second hinge housing 310 around the rotating portion 225 as a rotational axis, and the second hinge cover 220 may cover a front of one side of the second hinge housing 310 which is opened toward main body 10.

That is, as described above, as the second panel 222 is provided to correspond to the front of one side of the second hinge housing 310 which is opened toward the main body 10, the second hinge cover 220 may rotate around the rotating portion 225 as a rotational axis, and may cover the front of one side of the second hinge housing 310 which is opened toward the main body 10.

As is apparent from the above description, since a refrigerator in accordance with one embodiment of the present disclosure includes a hinge unit, and the hinge unit protrudes while a door is opening, the door is opened in a state in which the door protrudes, and thus the door is opened without being interfered with by a structure positioned at a side of the refrigerator.

In addition, in the refrigerator in accordance with one embodiment of the present disclosure, since a hinge cover is provided at one side of the hinge unit, a user's fingers are prevented from being jammed by the hinge unit.

The above-described detailed descriptions are only examples of the present disclosure. In addition, the above-described descriptions have described exemplary embodiments of the present disclosure, and the present disclosure may be used in various other combinations, modifications, and environment. That is, the present disclosure may be changed and modified in a range of the concept and in an equivalent range of the content of the disclosure disclosed in the present specification and/or in technology or knowledge in the art. The described embodiments describe the best state for implementing the concept of the present disclosure, and various modifications required for applying the present disclosure to specific fields and uses may be possible. Accordingly, the above-describe detailed description of the present disclosure does not limit the present disclosure to the embodiments disclosed. In addition, the appended claims should be interpreted to include other embodiments.

What is claimed is:

1. A refrigerator comprising:

a main body including a storage compartment;

a door configured to open and close the storage compartment; and a hinge unit provided in the main body and configured to permit the door to be rotatably coupled to the main body, wherein the hinge unit includes:

a first fixed hinge axis portion and a second fixed hinge axis portion provided in the main body;

a first movable hinge axis portion and a second movable hinge axis portion provided in the door; and a link portion configured to connect the first and second fixed hinge axis portions and the first and second movable hinge axis portions, wherein the link portion includes a first link member having one end rotatably coupled to the first fixed hinge axis portion and a second link member that intersect each other and a third link member having one end rotatably coupled to the second fixed hinge axis portion, when the door is open, the first link member and the second link member protrude to a front of the refrigerator, and one side of the third link member rotates and contacts an axis portion of the first link member at which the first link member and the first fixed hinge axis portion are coupled to each other, the third link member comprises a contact portion having a recessed shape corresponding to a circumferential surface of an axis portion of the first link member, such that the first link member rotates after the contact portion of the third link member contacts the axis portion of the first link member.

2. The refrigerator of claim 1, wherein the second fixed hinge axis portion is positioned closer to an inside of the storage compartment than the first fixed hinge axis portion, and when the door is opened, the first link member is configured to rotate around the first fixed hinge axis portion as an axis from an opening of the storage compartment until the third link member contacts the axis portion of the first link member.

3. The refrigerator of claim 1, wherein when the door is closed, the second movable hinge axis portion is positioned closer to a rotational axis of the door than the first movable hinge axis portion, and the second link member has both ends respectively and rotatably coupled to the other end of the third link member and the second movable hinge axis portion.

4. The refrigerator of claim 3, wherein the link portion further includes a fourth link member that has both ends respectively and rotatably coupled to the other end of the first link member and the first movable hinge axis portion.

5. The refrigerator of claim 1, further comprising a hinge cover provided at one side of the hinge unit and configured to cover at least a part of the hinge unit in conjunction with an opening operation of the door while the door is opening.

6. The refrigerator of claim 5, wherein when the door is closed, the hinge cover is positioned in the main body, and while the door is opening, the hinge cover is configured to slide and protrude toward an outside of the main body.

7. The refrigerator of claim 5, wherein the hinge cover includes:

a first hinge cover configured to cover at least a part of the hinge unit provided between the door and the main body while the door is opening; and a second hinge cover configured to cover at least a part of the hinge unit provided in the door while the door is opening.

8. The refrigerator of claim 7, wherein the second hinge cover includes:

two panels that face each other and are apart from each other;

two connection portions that respectively extend from the panels to connect both ends of the two panels, and are provided to have an arc shape; and a rotating portion which is coupled to the door and has a cylindrical shape configured to rotatably couple the second hinge cover to the door.

9. The refrigerator of claim 8, wherein the first hinge cover is provided to have a panel shape, one end of the first hinge cover includes a first sliding portion that has a cylindrical shape and is configured to slide in the main body so that the hinge cover slides from an inside of the main body to protrude, and the other end of the first hinge cover includes a second sliding portion configured to slide between the panels of the second hinge cover.

10. The refrigerator of claim 9, wherein the main body includes a first hinge housing that is opened toward the door, and wherein a part of the hinge unit is provided in the first hinge housing, and the first hinge housing includes a guide portion configured to guide the first sliding portion.

11. The refrigerator of claim 10, wherein the guide portion includes a stopping member provided at an opened side of the first hinge housing and configured to restrain a sliding of the first sliding portion, and when the first sliding portion contacts the stopping member, the first hinge cover is configured to be rotatable around the first sliding portion as an axis.

12. The refrigerator of claim 10, wherein the first hinge housing further includes an auxiliary cover in an outer direction of one opened side of the first hinge housing configured to cover upper and lower portions of the part of the hinge unit outside of the one opened side of the first hinge housing.

13. The refrigerator of claim 9, wherein the second sliding portion is inserted into the two panels of the second hinge cover, and is configured to slide from one connection portion provided at one side to the other connection portion provided at the other side while the door is opening or closing.

14. The refrigerator of claim 13, wherein the second sliding portion is provided to have a cylindrical shape corresponding to a circumferential surface of the connection portion, and configured so that the first and second hinge covers are rotatable when the second sliding portion slides from the one connection portion provided at one side to the other one connection portion provided at the other side and contacts one side of the other one connection portion provided at the other side.

15. The refrigerator of claim 8, wherein the door includes a second hinge housing opened toward the main body and an outer side of the door and wherein a part of the hinge unit is provided in the a second hinge housing, the rotating portion is provided at one side of the second hinge housing opened toward the main body, and the second hinge cover is provided to correspond to one opened side of the second hinge housing and configured to rotate around the rotating portion as an axis, and configured to cover the one opened side of the second hinge housing while the door is opening.

16. The refrigerator of claim 7, wherein the second hinge cover includes upper and lower covers that are bent at an upper end of the second hinge cover and are configured to extend to cover upper and lower portions of a part of the hinge unit.

17. The refrigerator of claim 1, wherein the door includes an external door that is configured to open or close an outer side of the door, and one side of the hinge unit further includes an external door hinge configured to rotatably couple the external door to the door.

18. A refrigerator comprising:

a main body including a storage compartment;

a door configured to open and close the storage compartment;

a hinge unit that is provided in the main body and configured to rotatably couple the door to the main body, and wherein the hinge unit includes a plurality of hinge axis portions and a link portion; and a hinge cover provided at one side of the hinge unit and configured to cover at least a part of the hinge unit in conjunction with an opening operation of the main body, wherein, the link portion comprises a first link member having one end rotatably coupled to a first fixed hinge axis portion, a second link member that intersects the first link member and is rotatably coupled to the first link member such that, when the door is opened, the first link member and the second link member extend away from the main body of the refrigerator, and a third link member having one end rotatably coupled to a second fixed hinge axis portion, and the third link member comprises a contact portion having a recessed shape corresponding to a first end of the first link member such that, when the door is opened, the third link member rotates until the contact portion of the third link member contacts the one end of the first link member.

19. The refrigerator of claim 18, wherein the first link member and the second link member protrude to a front of the refrigerator in conjunction with the opening operation of the door, and at least a part of the first link member and the second link member are positioned outside of a side of the main body.

20. The refrigerator of claim 19, wherein the first link member and the second link member are configured to perform a scissors movement and protrude to a front of the main body.

21. The refrigerator of claim 18, wherein when the door is closed, the hinge cover is positioned in the main body, and while the door is opening, the hinge cover is configured to slide and protrude to an outside of the storage compartment.

22. The refrigerator of claim 18, wherein the hinge cover includes:

a first hinge cover configured to cover a part of the hinge unit provided between the door and the main body while the door is opening; and a second hinge cover configured to cover a part of the hinge unit provided in the door while the door is opening, wherein the second hinge cover is configured to slide around one side of the first hinge cover as a center.

* * * * *